US005342259A

United States Patent [19]

Crichton

[11] Patent Number: 5,342,259

[45] Date of Patent: Aug. 30, 1994

[54] STARTING BLOCK

[76] Inventor: Ian J. Crichton, P.O. Box 1111, Springs, Transvaal Province, South Africa

[21] Appl. No.: 24,507

[22] Filed: Mar. 1, 1993

[30] Foreign Application Priority Data

Mar. 6, 1992 [ZA] South Africa ..... 92/1710

[51] Int. Cl.[5] ..... A63K 3/02

[52] U.S. Cl. ..... 482/19; 482/80

[58] Field of Search ..... 482/14, 19, 79, 80, 482/104, 142; 128/25 B

[56] References Cited

U.S. PATENT DOCUMENTS

| | | | |
|---|---|---|---|
| 3,342,485 | 9/1967 | Gaul | 482/104 |
| 3,802,700 | 4/1974 | Mayo | 128/25 B |
| 4,611,803 | 9/1986 | Newton . | |
| 4,650,183 | 3/1987 | McIntyre | 482/79 |
| 5,087,036 | 2/1992 | Cooper | 482/79 |

*Primary Examiner*—Richard J. Apley
*Assistant Examiner*—Lynne A. Reichard
*Attorney, Agent, or Firm*—Ladas & Parry

[57] ABSTRACT

A starting block 60 includes a foot-support means 12 and a heel-support portion 14. The heel-support portion 14 extends from the foot-support means 12, for supporting a user's heel, and is adjustably arranged relative to the foot-support means 12.

5 Claims, 4 Drawing Sheets

STARTING BLOCK

FIELD OF THE INVENTION

THIS INVENTION relates to a starting block and to an accessory for a starting block.

SUMMARY OF THE INVENTION

According to a first aspect of the invention, there is provided a starting block which includes a foot-support means; and a heel-support portion, extending from the foot-support means, for supporting a user's heel, the heel-support portion being adjustably arranged relative to the foot-support means.

The foot-support means may comprise a first support element for supporting a ball of a user's foot, and the heel-support portion may be defined by a second support element. The second support element may be adjustably mounted on the first support element.

Hence, the starting block may include an adjustment means for adjusting the position of the second support element relative to the first-support element. For adjustment purposes, the second support element may be pivotally mounted, via a pivot means, on the first support element.

The pivot means may include portions of the first support element and second support element which define corresponding, aligned apertures with a pivotal axis defining means being received through the apertures. The pivotal axis defining means may be a pivot pin.

The adjustment means may comprise an adjustment screw receivable in a threaded opening defined in an extension flange of the second support element. The extension flange may extend beyond an operatively bottom edge of the second support element so that the adjustment screw abuts against a rear surface of the first support element.

The starting block may further include a setting means for setting the angular position of the first support element relative to a substrate.

According to a second aspect of the invention, there is provided an accessory for a starting block, the accessory including a heel-support member for supporting a user's heel; and a mounting means for mounting the heel-support member on a part of the starting block.

The accessory may include an adjustment means for adjusting the position of the heel-support member relative to said part of the starting block. The adjustment means may be an adjustment screw which in use, abuts a rear region of said part of the starting block.

The mounting means may include a pivot means carried at an operatively lower end of the heel-support member for pivotally connecting the heel-support member to said part of the starting block.

The invention is now described, by way of example, with reference to the accompanying drawings.

DETAILED DESCRIPTION OF THE DRAWINGS

Figure 1:
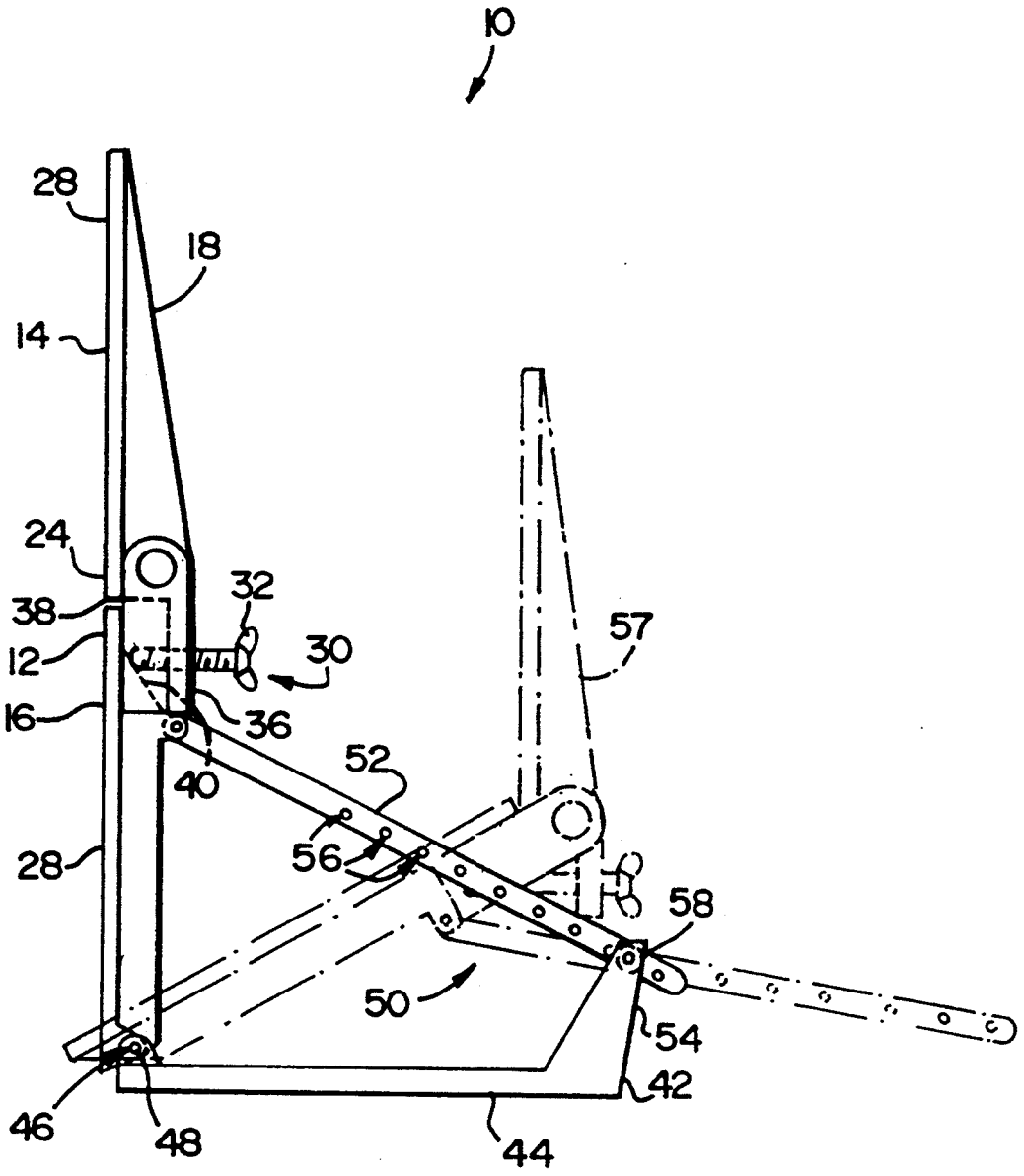
FIG. 1 shows a side elevation of a starting block in accordance with a first embodiment of the invention.
Figure 2:
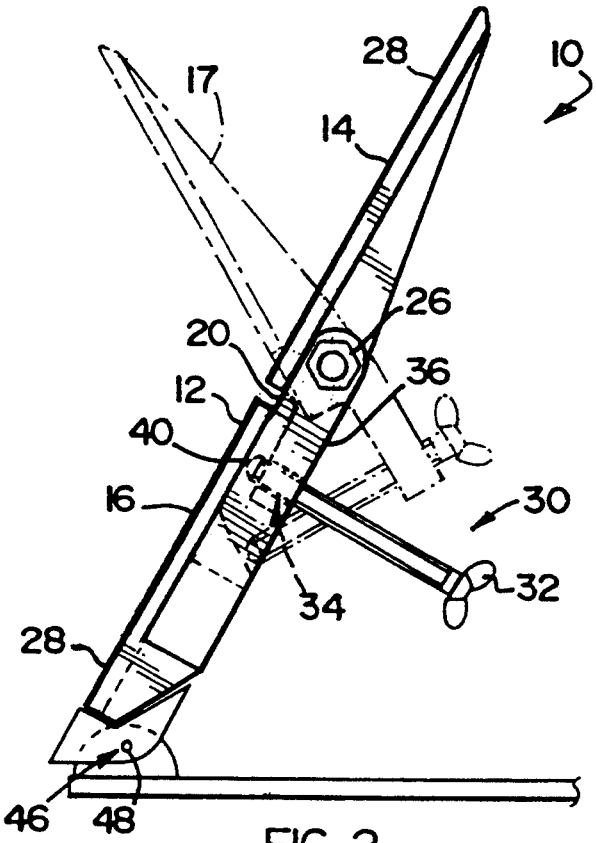
FIG. 2 shows a side elevation of the starting block of FIG. 1.
Figure 3:
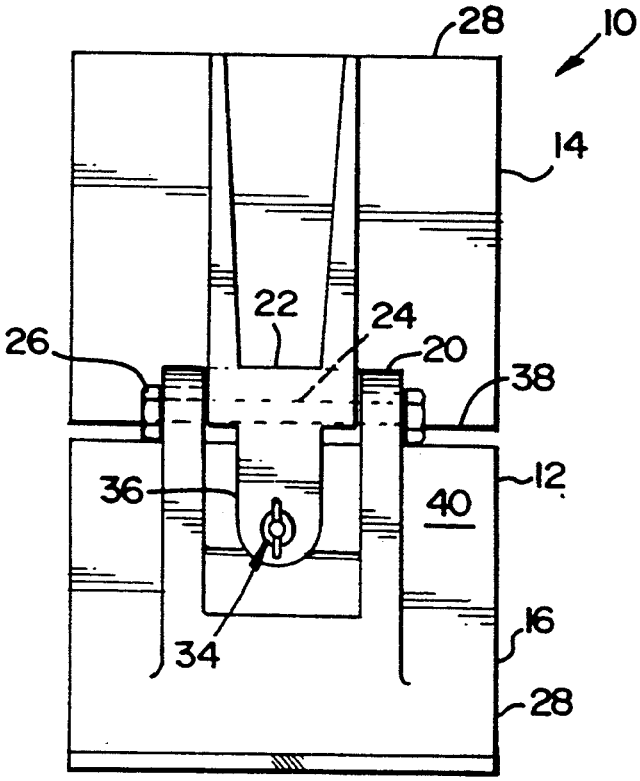
FIG. 3 shows a rear elevation of the starting block of FIG. 2.

In FIGS. 1 to 3 of the drawings, reference numeral 10 generally indicates a starting block in accordance with a first embodiment of the invention.

The starting block 10 comprises a foot-support means 12 and a heel-support portion 14 extending from the foot-support means 12. In use, the heel-support portion 14 supports a user's heel.

The foot-support means 12 comprises a first support element 16 for supporting a ball of a user's foot. Further, the heel-support portion 14 is defined by a second support element 18.

The second support element 18 is pivotally mounted on the first support element 16. Hence, a portion 20 of the first support element 16 and a portion 22 (FIG. 3) of the second support element 18 define corresponding aligned apertures 24 with a pivotal axis defining means, in the form of a shank of a bolt and nut combination 26, being receivable through the apertures 24.

The first and second support elements 16, 18 are in the form of flat aluminium plates 28.

The starting block 10 includes an adjustment means 30 for adjusting the position of the second support element 18 relative to the first support element 16. The adjustment means 30 comprises an adjustment screw 32 which is receivable in a threaded opening 34 defined in an extension flange 36 of the second support element 18. The flange 36 extends beyond an operatively bottom edge 38 of the second support element 18 so that the adjustment screw 32 abuts against a rear surface 40 of the first support element 16. Thus, in use, the angle of the second support element 18 relative to the first support element 16 is adjusted between the position shown in solid lines and the position shown in dotted lines (in FIG. 2) by turning the adjustment screw 32.

It is to be appreciated that, for stability, the starting block 10 includes a support portion 42. The support portion 42 includes a base member 44. The first support element 16 is pivotally mounted on the base member 44. Corresponding apertures 46 are defined on an operatively front end of the base member 44 and an operatively bottom edge of the first support element 16. A pivot pin 48 is received through these corresponding apertures 46 for effecting the pivotal mounting of the first support element 16 relative to the base member 44.

The starting block 10 further includes a setting means 50 for setting the angular position of the first support element 16 relative to the base member 44.

The setting means 50 includes an elongate arm 52 pivotally connected to the first support element 16. An upright extension 54 projects upwardly from an operatively rear end of the base member 44. A plurality of holes 56 are defined along the length of the arm 52. An opening 58 is defined in a free end of the extension 54 and a pin (not shown) is received through the opening 58 and one of the aligned holes 56 in the arms 52 to set the angle of the first support element 16 relative to the base member 44.

Figure 4:
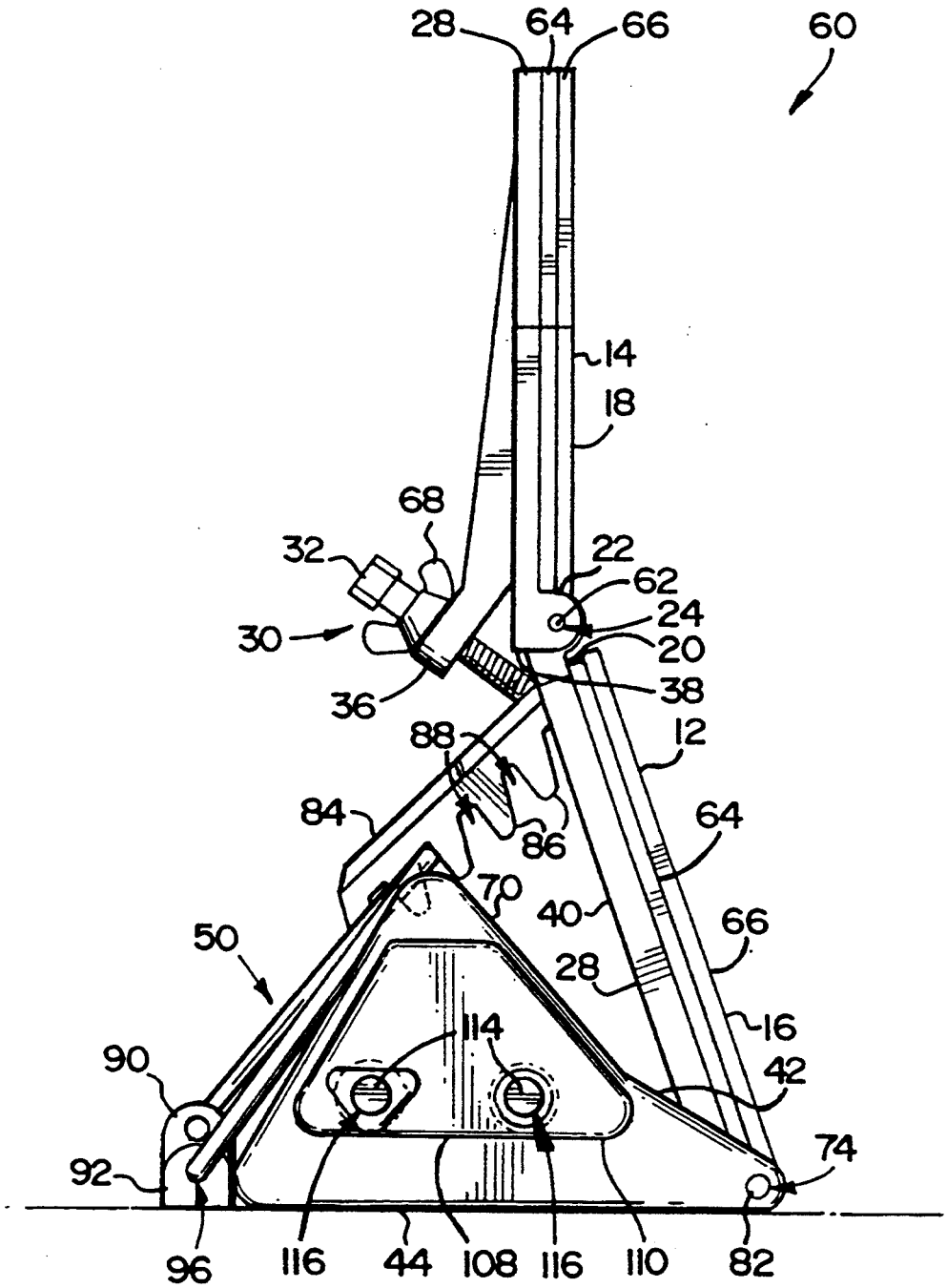
FIG. 4 shows a side elevation of a starting block in accordance with a second embodiment of the invention.
Figure 5:
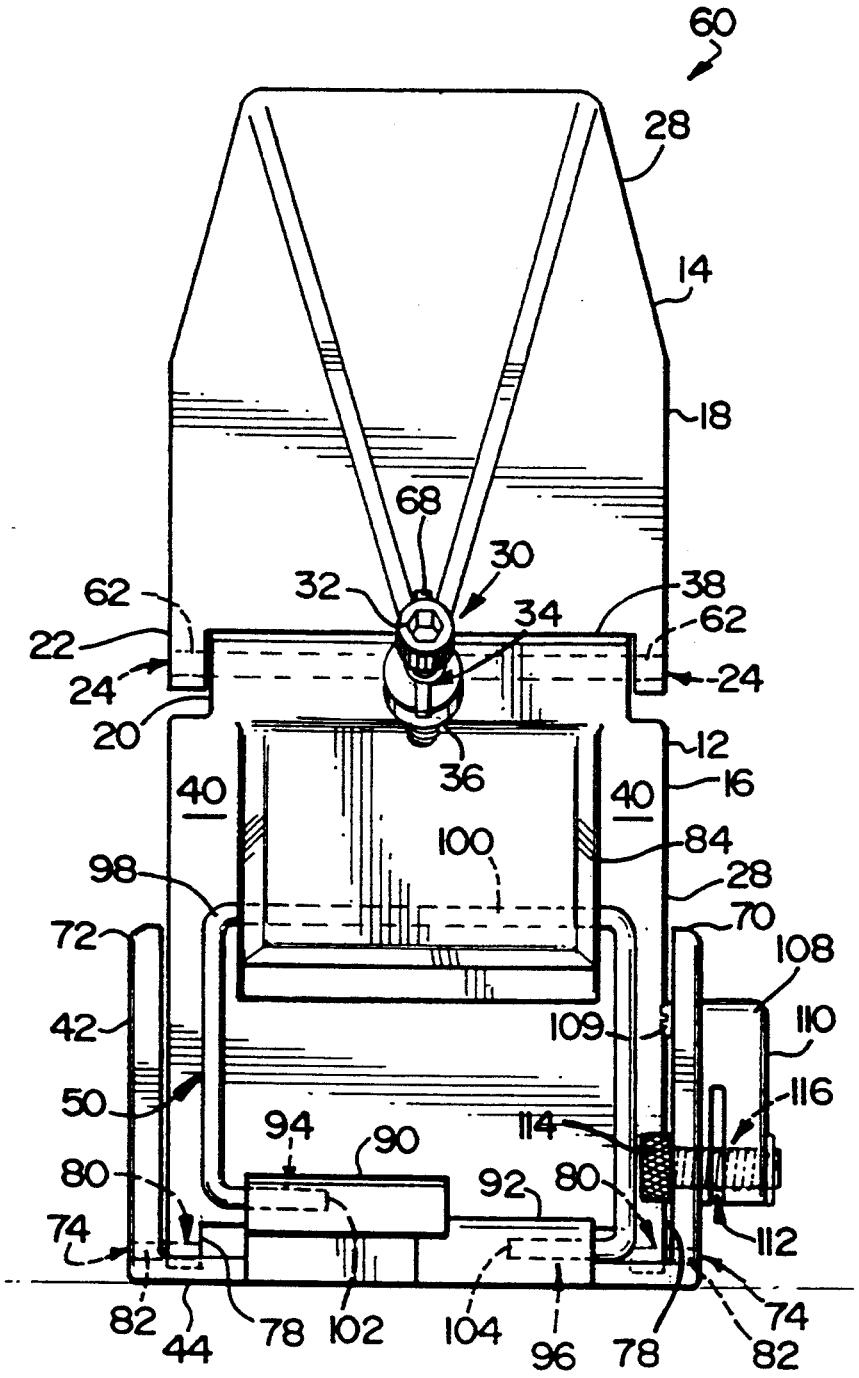
FIG. 5 shows a rear elevation of the starting block of FIG. 4.

In FIGS. 4 and 5, reference numeral 60 generally refers to a starting block in accordance with a second embodiment of the invention. With reference to FIGS. 1 to 3 of the drawings, like reference numerals refer to like parts, unless otherwise specified.

As with the starting block 10, the second support element 18 is pivotally mounted on the first support element 16. Here, the pivotal axis defining means is in the form of a pivot pin 62 received through the apertures 24.

The first and second support elements 16, 18 are in the form of flat, laminated elements. Hence, each of the elements 16, 18 includes a first layer comprising the flat aluminium plate 28. A second layer in the form of a sheet 64 of elastomeric material, such as foam rubber, is secured to the aluminium plate 28. A third, outer layer, in the form of a sheet 66 of an elastomeric material, such as rubber, is secured to the sheet 64. The sheet 64 is adhesively bonded to the plate 28. Similarly, the sheet 66 is adhesively bonded to the sheet 64.

As with the starting block 10, the starting block 60 has the adjustment screw 32. However, a locknut 68 is provided on the adjustment screw 32 to lock the adjustment screw 32 in position.

A first upright element 70 extends operatively upwardly from one side of the base member 44 while a second upright member 72 extends operatively upwardly from the other side of the base member 44. The first support element 16 is pivotally connected to the upright elements 70, 72. An aperture 74 is defined in each of the upright elements 70, 72. The first support element 16 has at its bottom edge two downwardly extending portions 78 in which apertures 80 are defined. The apertures 80 are aligned with the apertures 74. Pivot pins 82 are received in the apertures 74, 80 to provide for the pivotal mounting of the first support element 16 on the upright elements 70, 72.

As before, the starting block 60 includes a setting means 50 for setting the angular position of the first support element 16 relative to the base member 44.

The setting means 50 includes an aluminium adjusting plate 84 mounted on an upper part of the first support element 16 and extending outwardly and operatively downwardly therefrom. The adjusting plate 84 and the first support element 16 thus define an acute angle between them. A number of spaced projections 86 extend from the plate 84 towards the rear surface 40 of the first support element 16. The projections 86 are substantially tooth-like and are arranged along either side of the plate 84. The projections 86 define a number of pairs of aligned recesses 88 between them.

A first aperture defining member 90 and a second aperture defining member 92 are mounted in stepped relationship to each other at an operatively rear edge of the base member 44. The first and second aperture defining members 90, 92 define, respectively, first and second apertures 94, 96.

A steel bracing element 98 is provided which defines an engaging portion 100 which is received in one of the pairs of recesses 88 to set the angle of the element 16 relative to the base member 44. A first free end 102 of the bracing element 98 is received in the first aperture 94 and a second free end 104 is received in the second aperture 96 so that the bracing element can pivot relative to the base member 44. The recesses 8 are shaped so that, when the engaging portion 100 is received within a pair of the recesses 88 and pressure is exerted upon the first support element 16 and the second support element 18, the portion 100 is retained within its associated pair of recesses 88.

A fastening means 108 is provided for fastening the starting blocks 60 on to an elongate central member or rail (not shown). In use, two starting blocks 60 are mounted on the rail to form a pair of starting blocks. The fastening means 108 includes a slotted element 110 fixed to the upright element 70 by means of a screw 109. The slotted element 110 has a slot 112 defined therein in which the rail is receivable. Two fixing fasteners 114 extend through the upright element 70 and through threaded openings 116 defined in the slotted element 110. The fasteners 114 are receivable through openings (not shown) defined along the length of the rail. Thus, in use, the position of the starting block 60 on the rail is adjustable via the fasting means 108.

It will be appreciated that, in respect of both embodiments of the invention, the heel-support portion 14 can be provided as a separate element instead of being pivotally attached to the foot-support means 12. Then, the heel-support portion can be suitably attached to the foot-support means 12, for example, by being clipped to the foot-support means.

In a sprinting event, as far as the start is concerned, a conventional starting block does not provide support for a heel of a user. Thus, with a conventional starting block, when an athlete takes off, his or her heel is initially driven back causing time to be lost. In use, the starting block 10, 60 provides support for a user's heel and thus, on take off, the user's heel is inhibited from moving backwards, thereby improving the take off time of the athlete. In practice, it has been found that, by using the starting block 10, 60 of the invention, an athlete's time for the event is improved.

I claim:

1. A starting block which includes a base member mountable on a substrate;

a substantially planar foot-support means pivotally mounted via an operatively lower edge to the base member;

a substantially planar heel-support, arranged at an operatively upper edge of the foot-support means, for supporting a user's heel, the heel-support portion being angularly adjustably arranged relative to the foot-support means; and an adjustment means for effecting angular adjustment of the heel-support portion relative to the foot-support means, the adjustment means comprising an adjustment screw receivable in a threaded opening defined in an extension flange of the heel-support portion, the extension flange extending beyond an operatively bottom edge of the heel-support portion so that the adjustment screw abuts against a rear surface of the foot support means.

2. The starting block as claimed in claim 1, in which the foot-support means comprises a first support element for supporting a ball of a user's foot, and in which the heel-support portion is defined by a second support element.

3. The starting block as claimed in claim 2, in which the second support element is pivotally mounted, via a pivot means, on the first support element.

4. The starting block as claimed in claim 3, in which the pivot means includes portions of the first support element and second support element which define corresponding, aligned apertures with a pivotal axis defining means being received through the apertures.

5. The starting block as claimed in claim 2, which includes a setting means for setting the angular position of the first support element relative to a substrate.

* * * * *